US011002145B2

(12) United States Patent
Techer et al.

(10) Patent No.: US 11,002,145 B2
(45) Date of Patent: May 11, 2021

(54) METHOD FOR MANUFACTURING A TURBINE ENGINE CASING WITH ABRADABLE COATING

(71) Applicant: SAFRAN AIRCRAFT ENGINES, Paris (FR)

(72) Inventors: Marc-Emmanuel Jean Francois Techer, Moissy-Cramayel (FR); Hubert Jean Marie Fabre, Moissy-Cramayel (FR); Pauline Nathalie Six, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 275 days.

(21) Appl. No.: 16/303,561

(22) PCT Filed: May 18, 2017

(86) PCT No.: PCT/FR2017/051203
§ 371 (c)(1),
(2) Date: Nov. 20, 2018

(87) PCT Pub. No.: WO2017/203135
PCT Pub. Date: Nov. 30, 2017

(65) Prior Publication Data

US 2020/0308975 A1 Oct. 1, 2020

(30) Foreign Application Priority Data

May 24, 2016 (FR) ..... 1654605

(51) Int. Cl.
*F01D 11/12* (2006.01)
*F01D 25/24* (2006.01)

(52) U.S. Cl.
CPC ..... *F01D 11/122* (2013.01); *F01D 25/24* (2013.01); *F01D 11/127* (2013.01);
(Continued)

(58) Field of Classification Search
CPC .... F01D 11/122; F01D 11/125; F01D 11/127; F01D 21/045; F01D 25/24;
(Continued)

(56) References Cited

U.S. PATENT DOCUMENTS 4,600,619 A * 7/1986 Chee ..... B29C 53/824 428/118
2009/0151162 A1* 6/2009 Xie ..... F01D 21/045 29/888

(Continued)

FOREIGN PATENT DOCUMENTS

FR 2922950 A1 5/2009
WO 20131007937 A2 1/2013

OTHER PUBLICATIONS

Written Opinion received for PCT Patent Application No. PCT/FR2017/051203, dated Sep. 11, 2017, 4 pages of Original Document Only.

(Continued)

*Primary Examiner* — Igor Kershteyn
(74) *Attorney, Agent, or Firm* — Womble Bond Dickinson (US) LLP

(57) ABSTRACT

A method for manufacturing a panel for supporting at least one cartridge of abradable material for a turbine engine casing, the panel including at least one block of material and a rigid panel covering the at least one block of material, except for a free outer surface configured to be fixed to an inner surface of the casing, including: a step of machining the outer surface of the block of material according to a three-dimensional profile configured to match that of the inner surface of the casing, and a step of fixing the machined block to the rigid panel.

11 Claims, 3 Drawing Sheets

(52) U.S. Cl.
CPC ..... *F05D 2220/40* (2013.01); *F05D 2230/90* (2013.01); *F05D 2250/283* (2013.01); *F05D 2260/30* (2013.01); *F05D 2300/44* (2013.01); *F05D 2300/603* (2013.01)

(58) Field of Classification Search
CPC ..... F05D 2220/40; F05D 2230/90; F05D 2250/283; F05D 2260/30; F05D 2300/44; F05D 2300/603
See application file for complete search history.

(56) References Cited

U.S. PATENT DOCUMENTS

2009/0277153 A1* 11/2009 Harper ..... F02K 3/06 60/39.091
2011/0232833 A1* 9/2011 Collins ..... F02C 7/045 156/165
2013/0048414 A1* 2/2013 Gaudry ..... F02C 7/045 181/213
2014/0086734 A1* 3/2014 Xie ..... F01D 25/24 415/200
2014/0150262 A1 6/2014 Le et al.
2015/0218961 A1* 8/2015 Evans ..... F01D 25/243 415/9
2015/0267555 A1* 9/2015 Plante ..... F02K 3/06 415/119
2015/0267556 A1* 9/2015 Thomas ..... F01D 21/045 415/9
2016/0084086 A1* 3/2016 Reed ..... F01D 25/24 416/219 R

OTHER PUBLICATIONS

International Search Report received for PCT Patent Application No. PCT/FR2017/051203, dated Sep. 11, 2017, 5 pages (2 pages of English Translation and 3 pages of Original Document).

* cited by examiner

METHOD FOR MANUFACTURING A TURBINE ENGINE CASING WITH ABRADABLE COATING

The invention concerns especially a method for manufacturing a panel of abradable material for supporting a turbine engine casing.

Aeronautic turbine engines are mainly constituted by at least one compressor, wherein the air sucked into the air inlet of the turbine engine is compressed towards a combustion chamber wherein the injected fuel is burned, then transmitted to at least one turbine wherein the burned-off gases are expanded to drive the compressor secured in rotation to the turbine, and finally released by an ejection device. The compressors and the aeronautic turbines are constituted of fins, blades, which are moved in rotation inside a casing which ensures the sealing of the air path with the outside of the engine.

For example, the casing is constituted of a succession of rings with which the blades conserve a functioning clearance. This clearance must be sufficient such that no friction slows the rotation of the mobile parts, but it must be controlled to avoid a significant quantity of gas being diverted from the active surfaces of the blading units. In order to ensure an efficiency that is as high as possible, it is therefore important to control this clearance.

Indeed, it is known that the clearance between the ends of the mobile blades and the casing forming the inner wall of the air flow path decreases the efficiency of the turbine engine. In the case of a compressor casing especially, this clearance can notably modify and decrease the functioning of the compressor up to the appearance of a "pumping" phenomenon, which results from the uncoupling of the air stream of the surface of the blades. Controlling the circulation of air at the end of the blades, thus constitutes a core issue to, at the same time, obtain a good, aerodynamic efficiency of the compressor or of the turbine and, in the specific case of a compressor, to have a sufficient margin against the pumping phenomenon.

In a known manner, in order to control this clearance, the casing carries an annular cover with abradable material. This cover extends around and radially close to the blades, which can, when functioning, rub against the abradable material and wear it by friction. This allows to optimise the radial clearances between the blades and the casing which surrounds and therefore to limit the gas leaks at the radially outer tips or ends of the blades.

The casing can be made in the form of a one-piece ring, or a succession of ring sectors, and the same applies for the abradable material which can be made in the form of an annular cartridge of a succession of angular sectors of cartridges.

It is known to deposit the abradable material directly on a rigid element, as is the case in document FR-2.922.950-A1 which teaches the deposit of an abradable material directly on an inner ferrule of a rectifier, in rotating contact with a rotor.

However, the abradable material is preferably not fixed directly on the casing. Indeed, the casing receives a support panel constituted of a block of honeycomb material covered with a rigid panel, which ensures the support of the cartridge (s) made of abradable material.

PRIOR ART

According to the prior art of document US-2014/150262-A1, it is known to produce the casing from layers of a fibrous material which undergoes a resin injection, said resin being then polymerised directly on a block of honeycomb material.

According to the prior art, when the material is intended to be returned on an existing casing, it is known to produce the casing with an abradable coating according to three main successive manufacturing steps of the support panel, of machining the support panel, and of adhering the support panel on the casing.

During a first step of manufacturing the support panel, a block of honeycomb material is covered with a panel perform made of impregnated composite material, for example a preform made of carbon fibres impregnated by an epoxy resin. The preform includes a wall and edges defining rims, and to this end, during the covering of the block of honeycomb material with the preform, an intumescent material is interleaved between the edges of the block and the rims of the preform. Then, the assembly, shaped substantially in the form of a half-sandwich, is subjected to a simple cooking during a second step so as to form a raw support panel.

The inner surface of the casing does not necessarily correspond to the theoretical profile thereof. Especially, in the case of a casing made of a composite material, it has been observed that the inner surface of the casing after manufacture did not necessarily have a perfectly circular section, but could have an ovalisation of the section thereof. Furthermore, the inner surface of the casing can have possible surface defects.

It is therefore necessary to proceed with machining the outer surface of the support panel such that it best matches the inner surface of the casing in order to minimise the deformations that the support panel could be subjected to, as these deformations would consequently have to modify the position required for the cartridge of abradable material that the support panel must receive.

To do this, during a third step, the inner surface of the casing is measured so as to deduce from it a three-dimensional profile that the outer surface of the support panel must match. Then, during a fourth step, the support panel is placed in a suitable tooling allowing to restrict it along a position similar to that that it must occupy once mounted in the casing.

During a fifth step, the outer surface of the support panel is then machined according to a three-dimensional profile corresponding to that of the inner surface of the casing. These steps constitute the steps of manufacturing the support panel, and in this regard constitute a first phase of manufacturing the casing with abradable coating. Then, during a second phase of manufacturing the casing with abradable coating, the support panel is adhered on the casing and the abradable material is adhered on the support panel.

This design presents the disadvantage of requiring an operation of measuring the inner surface of the casing with the highly increased tolerances, as the reduced shape defect of the inner surface of the casing panel has consequences on the positioning of the support panel after its fixing.

Moreover, the machining operation is moreover very constricting through the tooling which is implemented for the fulfillment thereof. Indeed, once cooked, the support panel is found to be considerably rigidified, this rigidity being mainly ensured by the panel made of composite material. The stressing of the support panel in the tooling in order to stress it in the position that it must occupy once mounted in the casing involves a tooling capable of conferring suitable deformations, while ensuring an increased holding of the support panel. This tooling is therefore consequently complex and expensive.

Moreover, to obtain a satisfactory adherence of the panel made of composite material on the block of honeycomb material, it is necessary to cook the half-sandwich assembly in an autoclave enclosure. Consequently, the manufacturing in series of such cartridge supports of abradable material involves a rigorous management of usage time of autoclave enclosures, which complicates the production of these panels.

Finally, the insertion of the intumescent material between the edges of the block of honeycomb material and the rims of the panel made of composite material presents risks of deforming the support panel. Indeed, the expansion of the intumescent has a direct impact on the quality of the rims. The support panels produced according to the current state of the art especially include craters, porosities, delamination at the level of the rims, which requires, almost systematically, an adjustment of the rims to obtain the final support panel.

To overcome these disadvantages, it is desirable to allow the manufacturing of the support panel by using conventional cooking means and to make it possible for the machining of the block of honeycomb material with a reduced tooling and according to lower tolerances.

DESCRIPTION OF THE INVENTION

The invention therefore aims to simplify operations of preparing the raw support panel and the machining thereof with a view to adapt it on the inner surface of the casing.

With this aim, the invention proposes a method for manufacturing at least one panel for supporting a cartridge of abradable material for a turbine engine casing, said panel including at least one block of material, especially honeycomb material, and a rigid panel covering said block, except for an outer free surface configured to be fixed to an inner surface of the casing, characterised in that it includes:

- a step of machining the outer surface of the block of material according to a three-dimensional profile configured to match that of the inner surface of the casing, then
- a step of fixing the machined block to the rigid panel.

This new organisation of the steps of the method for manufacturing the support element allows, because of the fulfillment of the step of machining the material prior to its insertion into the rigid panel, to simplify this machining step, since it can be done without needing to have a specific tooling necessary for stressing the support element according to the shape that it will occupy in the casing. Moreover, the fixing of the block of material in the rigid panel allows to avoid the use of an intumescent material and consequently eliminate the defects that this was likely, in the prior art, to cause at the level of these rims.

According to other characteristics of the method for manufacturing the support element:

- during the machining step, the outer surface of the block is machined up to a determined thickness and prior to the fixing step, a rigid panel, including a wall and edges defining rims of a determined height, less than the determined thickness of the block are selected,
- during the fixing step, the wall of the panel made of composite material is adhered onto an inner surface of the block and the rims onto the edges of said block,
- the method includes a prior step of manufacturing the panel by cooking an impregnated composite material,
- the method includes a prior step of measuring dimensions of an inner surface of the casing to determine the three-dimensional profile of said inner surface.

The invention also proposes a support panel of at least one cartridge of abradable material for a turbine engine, said panel including at least one block of a material, especially honeycomb material, which includes an outer surface configured to be adhered to an inner surface of a turbine engine casing and which is covered with a rigid panel, said rigid panel including a wall covering an inner surface of the block and edges defining rims in regard to edges of said block, characterised in that the outer surface of the block is machined and in that the rigid panel is fixed to the block by way of an adhesive film, said adhesive film being interleaved between the wall of the panel and the inner surface of the block and between the rims of the panel and the side edges of said block.

According to other characteristics of the panel:

- a free end of the rims is arranged set back from the outer surface of the block,
- the panel is a cooked, impregnated composite material.

The invention also proposes a method for manufacturing a turbine engine casing with abradable coating, including a turbine engine casing covered with a support panel of the type described above receiving a cartridge of abradable material, characterised in that it successively includes a first phase during which the steps of a method for manufacturing a support panel such as described above are implemented to obtain at least one support panel, a second phase during which said support panel is adhered on the inner surface of the casing, and a phase during which a cartridge of abradable material is adhered onto said support panel.

According to another characteristic of the method for manufacturing the casing with abradable coating, the second phase of said method occurs simultaneously with the adhering step of the method for manufacturing the support panel.

The invention finally relates to a turbine engine including at least one casing with abradable coating obtained by the method described above.

The invention will be best understood and other details, characteristics and advantages of the present invention will appear more clearly upon reading the following description made as a non-limiting example, and in reference to the appended drawings, wherein.

In the following description, identical reference numbers mean identical parts, or parts with similar functions.

Through the present description, the orientations "inner" and "outer" are defined by reference to an axis of rotation of the rotors of a turbine engine, the orientations "outer" being rotated opposite said axis, and the orientations "inner" being rotated towards said axis.

Figure 1:
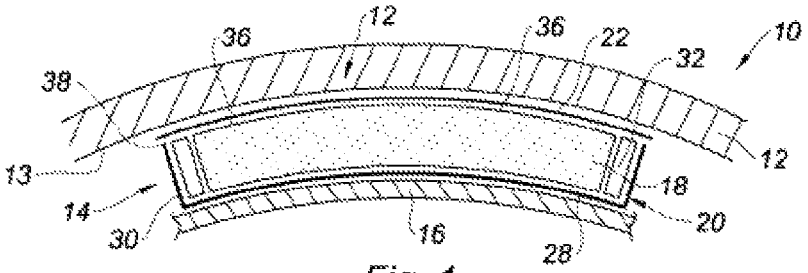
FIG. 1 is a schematic, cross-sectional view of a turbine engine casing with abradable coating according to a prior art.
Figure 5:
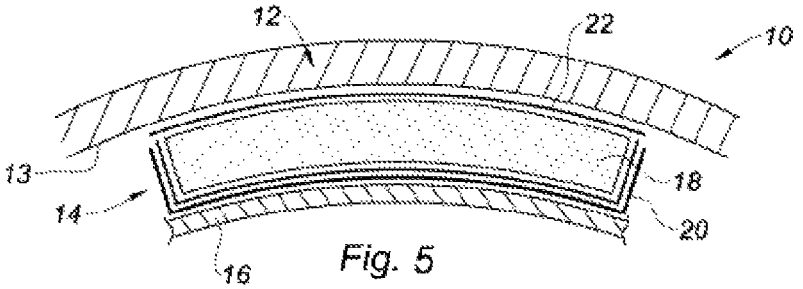
FIG. 5 is a schematic, cross-sectional view of a casing with abradable coating according to the invention.

In FIGS. 1 and 5, a casing with abradable coating 10 for a turbine engine has been represented.

In a known manner, such a casing with abradable coating 10 includes a bare casing 12 which is coated with a support panel 14 which is itself coated with a cartridge 16 made of abradable material.

The support panel 14 includes at least one block 18 of honeycomb material, known generally under the name of "Nida", and a rigid panel 20 which covers the block 18 and which is intended to receive the cartridge 16 made of abradable material.

Thus, the support panel 14 is shaped in the form of a half-sandwich which is fixed to an inner surface 13 of the casing 12 by way of an adhesive film 22.

The cartridge of abradable material 16 is fixed to the support element 14 by adhering, and especially, by cooking the abradable material. The cooking of the abradable material ensures the cohesion therefore with the support panel 14.

FIG. 1 illustrates more specifically a casing with abradable coating 10 produced conforming with a prior art. This casing with abradable coating 10 includes especially a support panel 14 which is produced according to a method which has been represented in FIGS. 2A and 2B corresponding to the steps of FIG. 4.

Figure 2A:
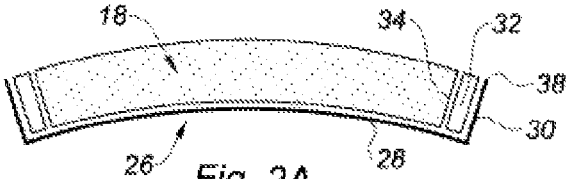
FIGS. 2A and 2B are schematic views representing a part of the steps of a method for manufacturing a support panel according to a prior art.

According to this method, during a first step ET1 which has been represented in FIG. 2A, a block 18 of honeycomb material is inserted into a panel perform 26 made of impregnated composite material, for example a perform 26 made of woven carbon fibres and impregnated with an epoxy resin. The preform 26 includes a wall 28 and the edges defining rims 30. During the insertion of the block 18 of honeycomb material in the preform, an intumescent material 32 is interleaved between the edges 34 of the block 18 of honeycomb material and the rims 30 of the preform 26.

The assembly shaped substantially in the form of a half-sandwich, is subjected to a simple cooking during a second step ET2 and so as to form a raw support panel.

Figure 2B:
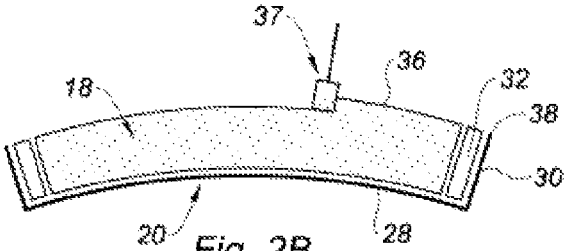

From this step ET2, the panel preform 26 made of composite material has become a rigid panel 20 such as represented in FIG. 2B. The block 18 of honeycomb material, the intumescent material 32, and the panel 20 are adhered to each other following the cooking of the composite material.

Moreover, the inner surface 13 of the casing 12 represented above in FIG. 1 does not necessarily correspond to the theoretical profile thereof. Especially, in the case of a rotating casing 12 made of composite material, it has been observed that the inner surface 13 of the casing 12 after manufacture could not present a perfectly circular section, but rather an ovalised section, unsuitable for receiving a compressor or turbine wheel of the turbine engine (not represented). Furthermore, the inner surface 13 of the casing 12 can present possible surface defects.

Insofar as the panel 20 is rigid and where the general shape thereof must no longer be modified, as it must have a minimum thickness, itself making it possible to support the cartridge of abradable material 16, it is therefore necessary to proceed with a machining of an outer surface 36 of the support panel 14 so that it matches the inner surface 13 of the casing 12 in order to minimise the deformations that the support panel 14 could be subjected to with respect to the theoretical profile thereof. Indeed, such deformations would consequently have to modify the position required for the support panel 14, and consequently for the cartridge of abradable material 16 that the support panel 14 must receive.

Figure 4:
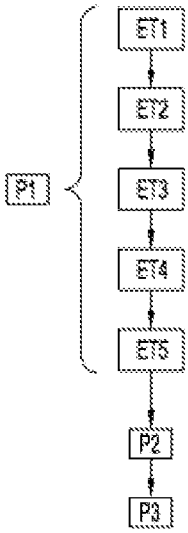
FIG. 4 is a flowchart representing the phases of a method for manufacturing the casing with abradable coating of FIG. 1.

To do this, as FIG. 4 illustrates it, during a third step ET3 (not represented), the inner surface 13 of the casing 12 is measured so as to deduce from it a three-dimensional profile that the outer surface 36 of the support panel 14 must match. Then, during a fourth step ET4, the support panel 14 is placed in a suitable tooling (not visible) which allows to stress the panel 14 according to a position, analogue to that that it must occupy once mounted in the casing 12.

For example, this stress can consist, when the panel 14 has an annular shape, of a radial stress being exerted along the whole of the periphery of the outer surface 36 of the panel 14 or, when the panel 14 presents a shape of angular sector as represented in FIGS. 2A and 2B, in a stress exerted radially over the periphery of the outer surface 36 and tangentially over the rims 30 of the panel 14, as the panel 14 is intended to be arranged between two panels 14 of the same type which consequently exert on it, tangential forces at the level of these two rims 30.

It will be understood that other stresses can be exerted to stress the panel 14 to the mounted position thereof in the casing 12, without limiting the invention.

Then, during a fifth step ET5 which has been represented in FIG. 2B, the outer surface 36 of the support panel 14 is then machined according to a three-dimensional profile, corresponding to that of the inner surface 13 of the casing 12, for example using an end mill 37.

Figure 3:
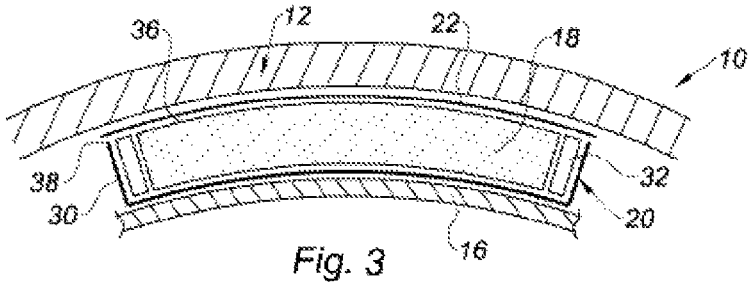
FIG. 3 is a schematic view representing a final phase of a method for manufacturing a casing with abradable coating of FIG. 1.

The first and fifth steps ET1 to ET5 of the method for manufacturing the support panel 14, comprising especially steps ET1 and ET5 which have been represented in FIGS. 2A and 2B, constitute a first phase P1 of the method for manufacturing the casing with abradable cover. Then, during a second phase P2 represented in FIG. 4 and illustrated in FIG. 3, the support panel 14 is adhered onto the inner surface 13 of the casing and finally, during a phase P3, the cartridge 16 of abradable material is adhered onto the support panel 14.

These methods present several disadvantages.

Firstly, they impose, during step ET3, an operation of measuring the inner surface 13 of the casing 12 with highly increased tolerances, as, like the support panel 14 is made rigid at the end of step ET2 of cooking the panel 20, the slightest shape defect of the inner surface 13 of the casing panel 12 leads to a defect in positioning the support panel 14 after the fixing thereof onto the casing 12.

Especially, as FIG. 1 illustrates it, with the outer ends 38 of the rims 30 being directly in contact with the inner surface 13 of the casing 12, any defect of this inner surface 13 leads to a defect in positioning the wall 28 of the support panel 14, and consequently the cartridge 16 of abradable material.

Secondly, the machining operation of step ET5 is moreover very constricting to implement, this by the nature of the tooling that it involves. As has been seen, once cooked, the support panel 14 is found considerably stiffened by the panel 20 made of composite material. The stressing of the support panel 14 in the tooling in order to stress in the position that it must occupy once mounted in the casing, involves a tooling capable of conferring the suitable deformations of the panel 14, while ensuring a holding such that it does not break free from said raised tooling of the support panel.

Thirdly, the second cooking step is itself problematic. Indeed, as the connection of the block 18 to the panel 20 is achieved by cooking the support panel 14 in the entirety thereof, it is necessary to cook this assembly as a half-sandwich in an autoclave enclosure. Consequently, the manufacturing in series of such supports 14 of cartridges of abradable material involves a thorough management of usage and occupation time of the autoclave enclosures which complicates the management of production flows.

Lastly, the insertion of the intumescent material 32 between the edges of the block of honeycomb material and the rims of the panel made of composite material increases the risks of deforming the support panel 14. Indeed, the expansion of the intumescent can produce craters, porosities, delamination at the level of the rims 30, which requires, almost systematically, an adjustment of the rims 30 to obtain the final support panel 14.

This disadvantage is overcome by proposing a method for manufacturing the support panel 14 and a method for manufacturing the casing with abradable coating 10 which advantageously allow the manufacturing of the support panel 14 by using conventional cooking means and allow the machining of the block 18 of honeycomb material with a reduced tooling and according to lower tolerances.

Figure 6A:
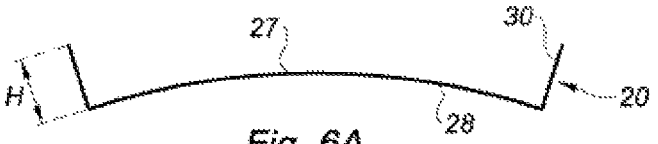
FIGS. 6A and 6B are schematic views representing a part of the steps of a method for manufacturing a support panel according to the invention.
Figure 6B:
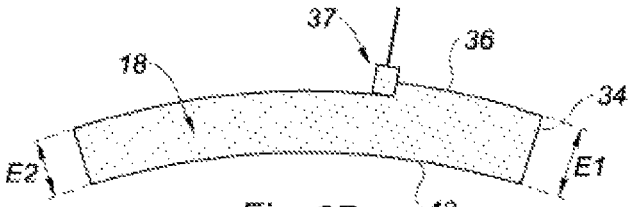
Figure 7:
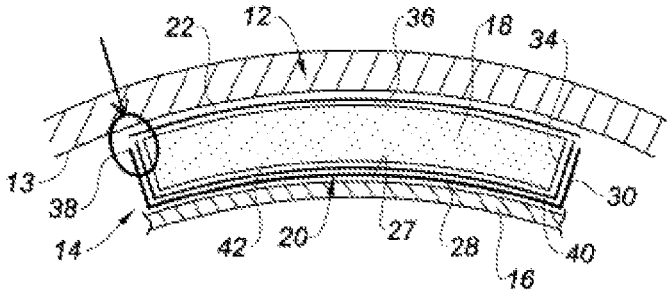
FIG. 7 is a schematic view representing a final phase of a method for manufacturing the casing with abradable coating of FIG. 5.

Conforming with the invention, as illustrated by FIGS. 6A, 6B and 7, the method successively includes at least one step ET5' of machining the outer surface 36 of the block 18 of honeycomb material according to a three-dimensional profile configured to match that of an inner surface of the casing, then a step ET6' of adhering the machined block 18 to the rigid panel 20.

The implementation of this method can assume the provision of a rigid panel 20 which can already be formed, and for example, form part of a panel 20 stock, available to the operator responsible for the manufacturing, or in a variant, of a panel which is formed at the time of the implementation of the method. Now, a preferred embodiment of the method will be described, being understood that this embodiment is not, in the organisation thereof, limiting of the invention, provided that the method includes at least one step of machining the outer surface 36 of the block 18 and the step of adhering the machined block 18 to the rigid panel 20.

Figure 8:
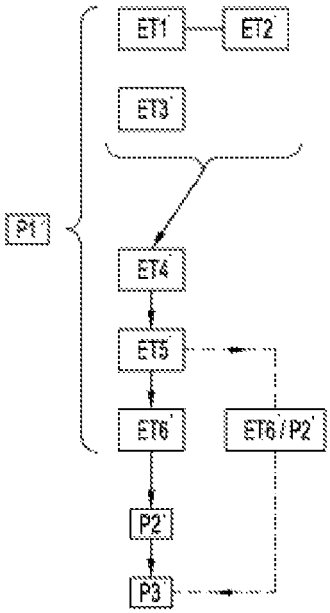
FIG. 8 is a flowchart representing the phases of a method for manufacturing the casing with abradable coating of FIG. 5.

As FIG. 8 illustrates, the method for manufacturing the support panel 14 according to the invention preferably includes a first step ET1', during which the panel 20 made of composite material is manufactured by cooking an impregnated composite material, for example a carbon fibre material impregnated with epoxy resin. A panel 20 is thus obtained, preferably rigid, including a wall 28 and rims 30, as represented in FIG. 6A. The panel 20 is configured to leave free, on the block 18, an outer surface 36 configured to be fixed to an inner surface 13 of the casing 12 such as represented in FIG. 5.

Then, or at the same time, as these operations can be led simultaneously, the method includes a step ET2' of cutting the block 18 of honeycomb material according to dimensions specific to being suitable to those of the wall 28 of the panel 20, the aim of this operation being, of course, to guarantee that the block 18 can be covered with the panel 20.

Then, or at the same time, as these operations can be led simultaneously, the method includes a third step ET3' of measuring the inner surface 13 of the casing 12 to determine the three-dimensional profile of said inner surface 13. This third step ET3' of the method is not limiting of the invention, but it allows, however, to characterise very precisely the profile of the inner surface 13 in order to specifically measure all the defects of it.

Then, during a fourth step ET4', the block 18 is positioned on a tooling (not visible), able to confer to it a position corresponding to the final position that it is intended to occupy in the panel 14 mounted in the casing 12.

Advantageously, as the block 18 is not rigidified by the rigid panel 20, the tooling used does not require to prestress the block 18 to obtain the final position that it is intended to occupy in the panel 14 mounted in the casing 12. This configuration allows to use a simpler tooling.

Then, at least one step ET5' of machining the outer surface 36 of the block 18 of honeycomb material is carried out according to a three-dimensional profile, configured to match that of the inner surface 13 of the casing 12, as represented in FIG. 6B.

With respect to the method such as described above in reference to the state of the art, this method advantageously allows to machine a block 18 of honeycomb material which is more flexible that above, as it is not rigidified by the rigid panel 20. Because of this, the machining can be advantageously done as above, with an end mill 37, but it is not necessary to have a tooling making it possible to stress and to precisely hold the block 18 of honeycomb material, as it is not rigidified by the panel 20 and is therefore more flexible.

Then, as FIG. 7 illustrates it, during a step ET6' of adhesion, the previously machined block 18 of honeycomb material is fixed to the panel 20 by way of an adhesive film 40.

Preferably, by way of the adhesive film 40, an outer surface 27 of the wall 28 of the panel made of composite material 20 is adhered onto an inner surface 42 of the block 18 of honeycomb material, and the rims 30 onto the edges 34 of said block 18 of honeycomb material.

Advantageously, in the preferred embodiment of the method for manufacturing the support element 14, the block 18 of honeycomb material is machined during the step ET5' according to a thickness E1, represented in FIG. 6B.

During the first step ET1', a rigid panel 20 including edges defining rims 30 of determined height H, as represented in FIG. 6A, is manufactured or selected. The height H of the rims 30 is provided to be less than the height E1 of the block 18.

This configuration is particularly advantageous. Indeed, the support panel 14 obtained presents rims 30 of which the free end is therefore likely to be arranged set back from the plane of the outer surface 36 of the block 18.

This configuration allows to guarantee that, when the block 18 of honeycomb material is assembled with the rigid panel 20, the outer ends 38 of the rims 30 do not come and touch the inner surface 13 of the casing 12, as represented by the detail marker and the associated arrow represented in FIG. 7. Thus, any residual defect of the inner surface 13 of the casing 12 is not transmitted by the rigid panel 20 to its wall 28, and has no consequence on the positioning of its wall 28.

In addition, this configuration allows the use of a standard composite panel 20 whose rims 30 require no machining. A simple selection of the composite panel in a stock of composite panels of different heights makes it possible to find the one whose height H can be suitable for the block 18, without the height of its rims 30 exceeding the height E1 of the block 18.

The first and fifth steps ET1' to ET6' of the method for manufacturing the support panel 14 according to the invention, comprising especially steps ET1' and ET5' which have been represented in FIGS. 6A and 6B, constitute a first phase P1' of the method for manufacturing the casing with abradable coating 10. Finally, during a second phase P2' of the method for manufacturing the casing with abradable coating 10 which has been represented in FIG. 8 and illustrated in FIG. 7, the support panel 14 is adhered onto the inner surface 13 of the casing and during a third phase P3', the cartridge 16 of abradable material is adhered onto the support panel 14.

Advantageously, as the variant of the method illustrates it as a dotted line in FIG. 8, the sixth step ET6' for manufacturing the support panel 14 can coincide with the second phase P2' of the method for manufacturing the casing with abradable coating 10, insofar as the adhering of the block 18 to the panel 20 can be done in one single operation at the same time as that of the outer surface 36 of the block 18 on the inner surface 13 of the casing 12. The grouping together of adhesion operations therefore allows to avoid the addition of an additional step to the method, which preserves the same number of steps as methods according to the state of the art, whilst avoiding its disadvantages and without requiring independent cooking to fix the panel 20 to the block 18 and to fix the block 20 to the casing 12.

The invention is particularly applied to a support panel 14 intended to provide a casing with abradable coating 10 with a turbine engine, whether a casing with abradable coating 10 intended for a compressor path or turbine of said turbine engine.

The invention claimed is:

1. A method for manufacturing a panel for supporting at least one cartridge of abradable material for a turbine engine casing, said panel including at least one block of material and a rigid panel covering said block, except for a free outer surface configured to be fixed to an inner surface of the casing, wherein said method includes:

a step of machining the outer surface of the block of material according to a three-dimensional profile configured to match that of the inner surface of the casing, then a step of fixing the machined block to the rigid panel.

2. The method according to claim 1, wherein during the machining step, the outer surface of the block is machined up to a determined thickness, and in that, prior to the fixing step, a rigid panel including a wall and edges defining rims of determined height less than said determined thickness of the block are selected.

3. The method according to claim 2, wherein during the fixing step, the wall of the panel is adhered onto an inner surface of the block and the rims onto the edges of said block.

4. The method according to claim 1, wherein it includes a prior step of manufacturing the panel by cooking an impregnated composite material.

5. The method according to claim 1, wherein it includes a prior step of measuring dimensions of an inner surface of the casing to determine the three-dimensional profile of said inner surface.

6. A panel for supporting at least one cartridge of abradable material for a turbine engine, said panel including at least one block of material which includes an outer surface configured to be adhered to an inner surface of a turbine engine casing and which is covered with a rigid panel, said rigid panel including a wall covering an inner surface of the block and edges defining rims in regard to edges of said block, wherein the outer surface of the block is machined and in that the rigid panel is fixed to the block by way of an adhesive film, said adhesive film being interleaved between the wall of the panel and the inner surface of the block and between the rims of the panel and the side edges of said block.

7. The panel according to claim 6, wherein a free end of the rims is arranged set back from the outer surface of the block.

8. The panel according to claim 6, wherein the panel is made of a cooked, impregnated composite material.

9. The method for manufacturing a turbine engine casing with abradable coating, including the turbine engine casing covered with a panel for supporting at least one cartridge of abradable material for a turbine engine, said panel including at least one block of material which includes an outer surface configured to be adhered to an inner surface of the turbine engine casing and which is covered with a rigid panel, said rigid panel including a wall covering an inner surface of the block and edges defining rims in regard to edges of said block, wherein the outer surface of the block is machined and in that the rigid panel is fixed to the block by way of an adhesive film, said adhesive film being interleaved between the wall of the panel and the inner surface of the block and between the rims of the panel and the side edges of said block, said panel receiving a cartridge of abradable material, wherein said method successively includes a first phase during which the steps of the method for manufacturing a panel according to claim 1 are implemented, to obtain at least one panel, a second phase during which said panel is adhered on the inner surface of the casing, and a third phase during which a cartridge made of abradable material is adhered on said panel.

10. The method for manufacturing a casing with abradable coating according to claim 9, wherein the second phase of said method occurs simultaneously with the adhering step of the method for manufacturing the panel.

11. A turbine engine including at least one panel for supporting at least one cartridge of abradable material for the turbine engine, said panel including at least one block of material which includes an outer surface configured to be adhered to an inner surface of a turbine engine casing and which is covered with a rigid panel, said rigid panel including a wall covering an inner surface of the block and edges defining rims in regard to edges of said block, wherein the outer surface of the block is machined and in that the rigid panel is fixed to the block by way of an adhesive film, said adhesive film being interleaved between the wall of the panel and the inner surface of the block and between the rims of the panel and the side edges of said block, said panel obtained by the method according to claim 1.

* * * * *